US007905561B2

(12) United States Patent
Ritter

(10) Patent No.: US 7,905,561 B2
(45) Date of Patent: Mar. 15, 2011

(54) PULL-OUT GUIDE FOR DRAWER

(75) Inventor: Thomas Ritter, Lustenau (AT)

(73) Assignee: Julis Blum GmbH, Hochst (AT)

( * ) Notice: Subject to any disclaimer, the term of this patent is extended or adjusted under 35 U.S.C. 154(b) by 0 days.

(21) Appl. No.: 12/611,270

(22) Filed: Nov. 3, 2009

(65) Prior Publication Data

US 2010/0045153 A1 Feb. 25, 2010

Related U.S. Application Data

(63) Continuation of application No. PCT/AT2008/000094, filed on Mar. 18, 2008.

(30) Foreign Application Priority Data

May 7, 2007 (AT) ..... A 697/2007

(51) Int. Cl.
*A47B 88/00* (2006.01)

(52) U.S. Cl. ..... 312/333; 312/334.45

(58) Field of Classification Search ..... 312/333, 312/334.44–334.47, 334.6, 334.1, 334.7–334.18
See application file for complete search history.

(56) References Cited

U.S. PATENT DOCUMENTS

| | | | | |
|---|---|---|---|---|
| 3,904,254 | A | 9/1975 | Hagen et al. | |
| 5,671,988 | A * | 9/1997 | O'Neill | 312/334.44 |
| 6,015,199 | A * | 1/2000 | Netzer et al. | 312/334.8 |
| 6,945,620 | B2 * | 9/2005 | Lam et al. | 312/334.6 |
| 7,296,863 | B2 * | 11/2007 | Lam et al. | 312/334.6 |
| 7,309,115 | B2 * | 12/2007 | Blum et al. | 312/334.13 |
| 7,320,508 | B2 * | 1/2008 | Booker et al. | 312/334.6 |
| 7,731,313 | B2 * | 6/2010 | Chen | 312/334.45 |
| 7,762,637 | B2 * | 7/2010 | Lam et al. | 312/334.6 |
| 2003/0234604 | A1 * | 12/2003 | Lin | 312/334.6 |
| 2004/0227444 | A1 * | 11/2004 | Booker et al. | 312/334.45 |
| 2005/0231083 | A1 * | 10/2005 | Garcie | 312/333 |
| 2006/0091770 | A1 | 5/2006 | Ritter et al. | |
| 2007/0046158 | A1 * | 3/2007 | Hoffman | 312/333 |
| 2009/0238503 | A1 * | 9/2009 | Liang et al. | 384/18 |

FOREIGN PATENT DOCUMENTS

| | | |
|---|---|---|
| DE | 10 2005 019 341 | 2/2006 |
| DE | 10 2005 050 353 | 5/2006 |
| EP | 1 393 654 | 3/2004 |

OTHER PUBLICATIONS

International Search Report issued Sep. 30, 2008 in International (PCT) Application No. PCT/AT2008/000094.
Austrian Search Report issued Jan. 11, 2008 in Austrian Application No. A 697/2007.

* cited by examiner

*Primary Examiner* — Janet M Wilkens
(74) *Attorney, Agent, or Firm* — Wenderoth, Lind & Ponack, L.L.P.

(57) ABSTRACT

A pull-out guide for drawers includes a first and at least one second rail, and at least one carriage with load-transmitting roller bodies being arranged between the two rails. The carriage can be coupled to the second rail, particularly when deviating from the differential course between the two rails. A rolling or sliding body is mounted in a freely movable manner on or in the carriage, through which the carriage can be coupled to a coupling part on the second rail. A recess is provided in the first rail into which the rolling or sliding body can be moved during opening of the drawer. The coupling part can de decoupled from the rolling or sliding body and passes along the carriage.

20 Claims, 8 Drawing Sheets

S
7
12a
8
A
B
C
ΔH
D
E
F
14
12a
ΔX
7

S'
8
A'
B'
C'
D'
E'
F'
12a
14
7
14
ΔB
7

A

PULL-OUT GUIDE FOR DRAWER

This application is a Continuation of International application No. PCT/AT2008/000094, filed Mar. 18, 2008, the entire disclosure incorporated herein by reference.

BACKGROUND OF THE INVENTION

The present invention relates to a pull-out guide assembly for drawers comprising a first and at least one second rail, wherein arranged between those two rails is at least one running carriage with load-transmitting rolling bodies. The running carriage—in particular upon a deviation from the differential movement between the rails—can be coupled to the second rail.

As a result of the slip between the rollers of the running carriage and the guide profiled sections of the rails, it is not always guaranteed that, when the drawer is pulled out and pushed in, the running carriages cover exactly half the travel distance of the pull-out rail. That results in what are referred to as running carriage errors, in which the position of the running carriage is not correct in relation to the carcass and pull-out rail. Carriage running errors of this kind can in some cases result in the drawer staying open in normal use.

The problems involved with such running carriage errors are known in the state of the art and repeatedly occur in the case of pull-out guide assemblies in which the load of the drawer is transmitted by rollers which are not borne on the rails but in separate running carriages. If the drawer is only moved manually, these errors are in many cases not noticed. If the drawer is pulled into the fully closed position by a conventional closure system with springs, then in most cases there is so much momentum for the carriage running error to be corrected by the dynamic of the drawer and for the drawer always to close.

In the case of pull-out guide assemblies with a closure device, additional damping devices are frequently provided. These devices damp the drawer over the last motion distance to the respective end position, so that the drawer is not pulled into the furniture body or carcass with too much force. However, these damping devices reduce the closing dynamic of the drawer such that a carriage running error occurring while the drawer is moving can no longer be compensated due to the lack of kinetic energy.

A solution for overcoming that problem is described for example in European patent specification EP 1 393 654 B1 issued to the present applicants. In that case, the running carriages are provided with arresting means which, upon a deviation from the differential movement between the rails, arrest the running carriage at predetermined locations between the two end positions with respect to one of the rails. That arresting action is releasable by displacement of the rails relative to each other. After release of the arresting effect, the running carriages are movable beyond the predetermined locations in the direction of the end positions. That arrangement therefore ensures that correction of the position of the running carriage is effected before it has reached the end region of the retraction path.

SUMMARY OF THE INVENTION

The object of the present invention is to provide a possible way of correcting carriage running errors, in which it is possible to dispense with complicated and expensive structural components.

In an advantageous configuration, the object according to the invention is achieved in that a rolling or sliding body (collectively referred to as simply "sliding body") is loosely displaceably mounted on or in the running carriage. As a result, the running carriage can be coupled to a coupling portion arranged on the second rail, and provided on the first rail is an evasion opening into which the rolling or sliding body is movable upon opening of the drawer. The coupling portion can be uncoupled from the rolling or sliding body and passes the running carriage.

In the case of a carriage running error occurring, which usually ranges in the region of magnitude of only a few millimeters, the running carriage can be coupled to the movement of the drawer over a comparatively short distance by way of the loosely guided rolling or sliding body (sliding body). The speed of the drawer movement—as is usual in the case of differential pull-out guide assemblies—is approximately double the speed of that of the running carriage. In the course of such coupling, the carriage running error can be corrected. Subsequently thereto it is provided that the rolling or sliding body is movable into an evasion opening in which the coupling effect is discontinued so that the drawer is movable substantially freely in the direction of the open position, whereby the uncoupled rolling or sliding body passes out of the evasion opening at a predetermined exit location and is movable as part of the running carriage in the direction of the outer end position.

In accordance with a preferred embodiment of the invention, the rolling or sliding body is mounted vertically movably, preferably loaded by the force of gravity, substantially perpendicularly to the extension direction of the rails. In that connection, the evasion opening includes a recess which is arranged or provided in the first rail, preferably in the form of a slot, into which the rolling or sliding body can be immersed so that the coupling between the running carriage and the second rail can be released thereby.

In the closing process of the drawer, on the contrary, the rolling or sliding body remains uncoupled with respect to the coupling portion. In that case—in the closing movement of the rails—the coupling portion can be brought into contact with the rolling or sliding body and can be guided laterally past the evasion opening. More specifically in the case of the closing process, the rolling or sliding body is to be moved again into the initial position for the next drawer opening movement, for which reason the rolling or sliding body is guided similarly to a bypass around the evasion opening and in that case is not to pass into the evasion opening. A certain lateral displaceability is to be admitted for that purpose (in a plan view onto the rail and in displaced relationship with the extension direction thereof). In other words, the rolling or sliding body is mounted movably in the rail plane transversely, preferably substantially perpendicularly, to the extension direction of the drawer. For that lateral mobility option, it may be desirable if the running carriage has a guide in which the rolling or sliding body is mounted limitedly movably within predetermined limits. In this connection in accordance with a preferred embodiment, the rolling or sliding body can be acted upon within the guide by a spring device, by which the rolling or sliding body upon closure of the drawer is movable again into an initial position for the opening movement of the drawer. In the closing process, the coupling portion pushes the rolling or sliding body laterally past the evasion opening, whereupon the spring device provided compensates for that lateral displacement.

The drawer according to the invention is characterized by a pull-out guide assembly of the described kind and the item of furniture according to the invention has a drawer of the general kind set forth hereinbefore.

BRIEF DESCRIPTION OF THE DRAWINGS

Further details and advantages of the present invention are described hereinafter with reference to the specific description. In the drawings.

DETAILED DESCRIPTION OF THE INVENTION

Figure 1:
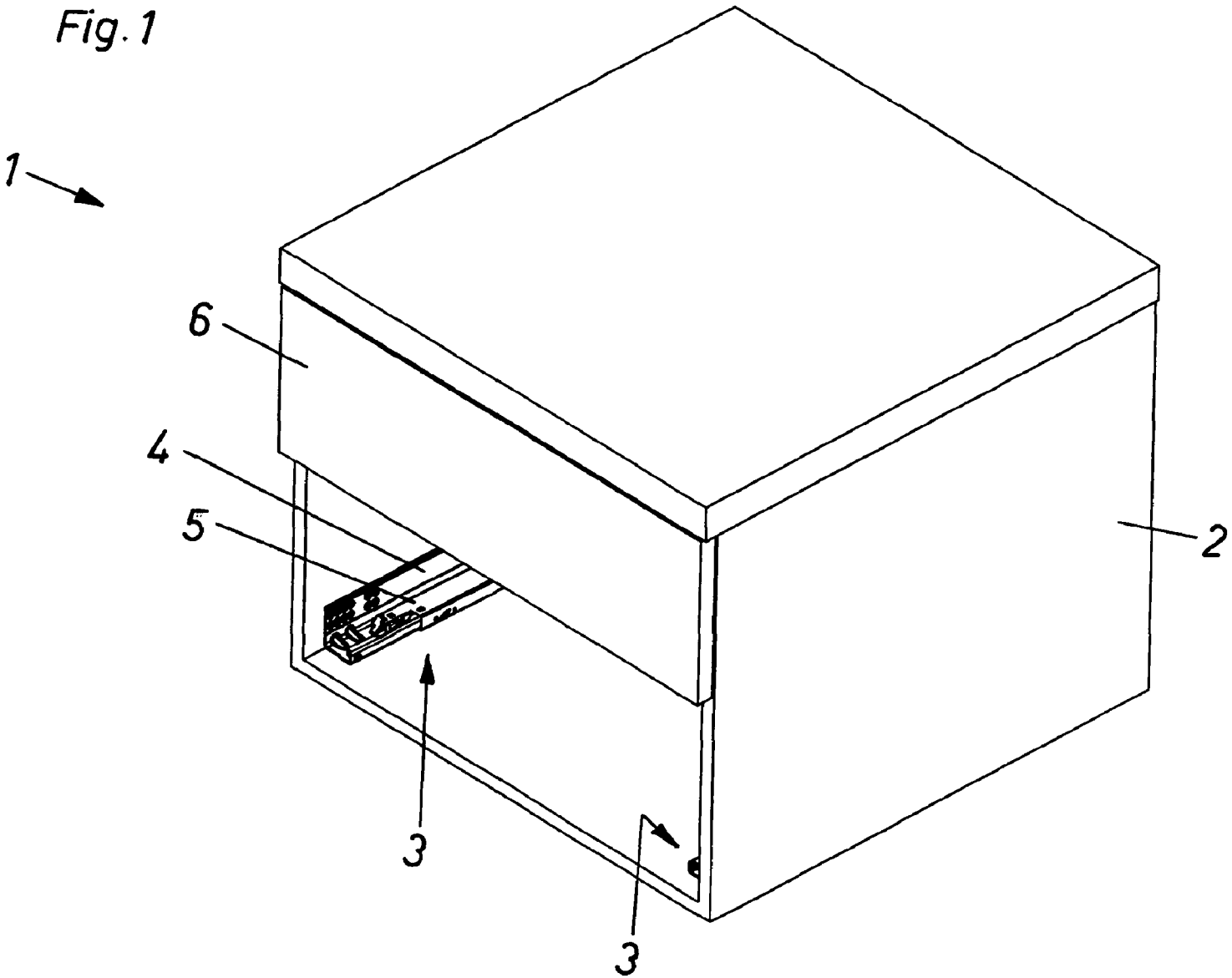
FIG. 1 shows a cabinet piece of furniture having drawers which are mounted movably by means of pull-out guide assemblies according to the invention.

FIG. 1 shows an item of furniture 1 in cabinet form having a furniture body or carcass 2, to the lateral inside walls of which is fastened a respective pull-out guide assembly 3 according to the invention. The pull-out guide assembly 3 comprises a carcass rail 4 to be mounted to the furniture carcass 2 and at least one drawer rail 5 which is mounted displaceably relative thereto and which is to be fastened to the drawer 6. The lower drawer 6 has been removed for the sake of clarity of the drawing. The pull-out guide assembly 3 can comprise a three-part rail system so that the drawer 6 can be pulled entirely out with respect to the furniture carcass 2. For that purpose in known fashion the pull-out guide assembly 3 comprises a carcass rail, a drawer rail and a middle rail guided displaceably between those two rails.

Figure 2:
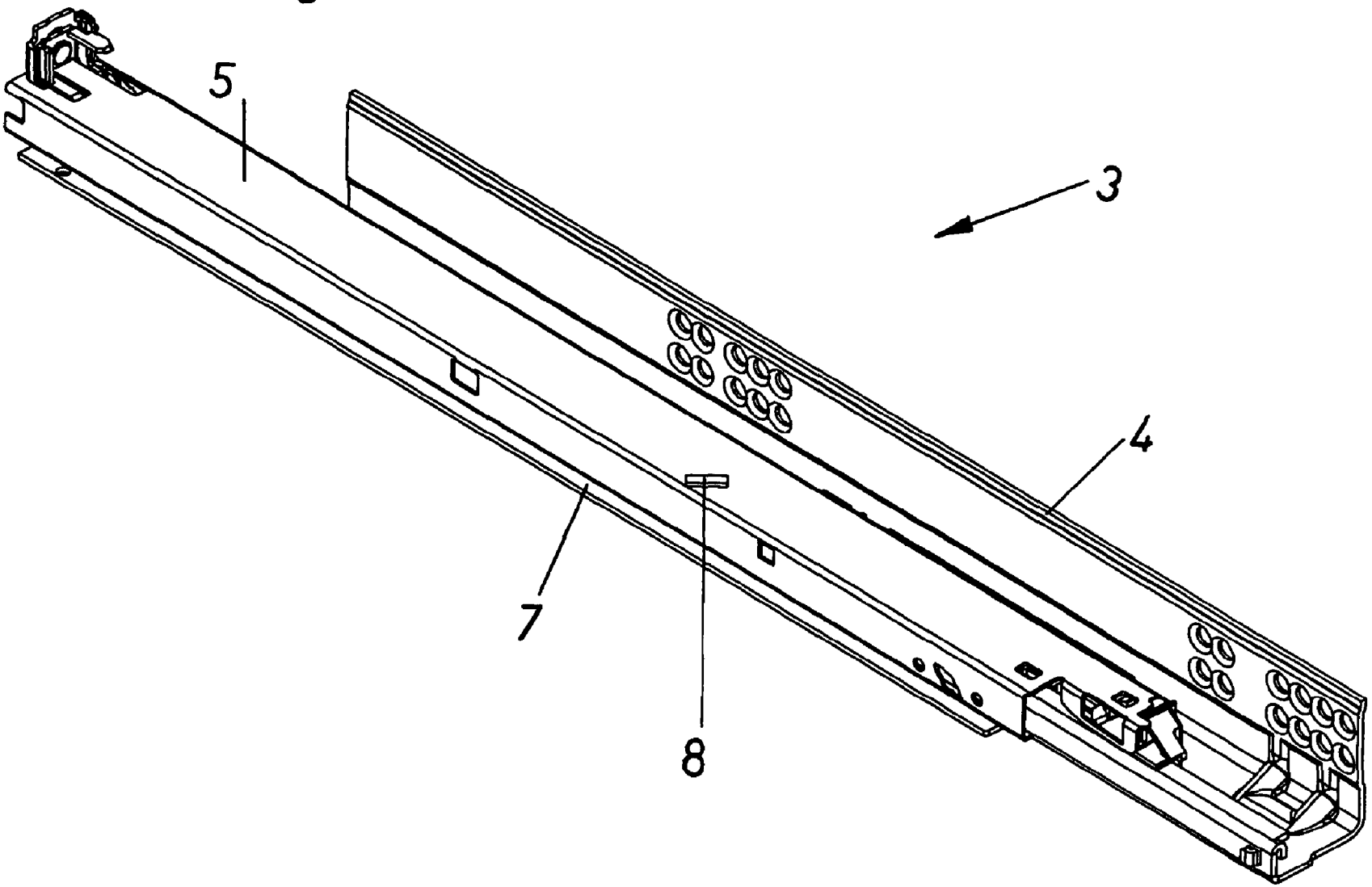
FIG. 2 shows a perspective view of a pull-out guide assembly as shown in FIG. 1.

FIG. 2 shows a perspective view of the pull-out guide assembly 3 with the carcass rail 4 to be fastened to the furniture carcass 2 and the pull-out drawer rail 5 to be fastened to the drawer 6. It is also possible to see in part a rail 7 which is provided as a middle rail disposed between the two rails 4 and 5. In the context of this description the middle rail is referred to as the first rail 7, the drawer rail as the second rail 5 and the carcass rail as the third rail 4. It is also possible to see a diagrammatically indicated coupling portion 8 which projects downwardly at the underside of the runner limb of the displaceable second rail 5 and which is arranged in the form of an inclined surface transversely relative to the extension direction of the pull-out rail 5, the function of the coupling portion 8 being described hereinafter.

Figure 3:
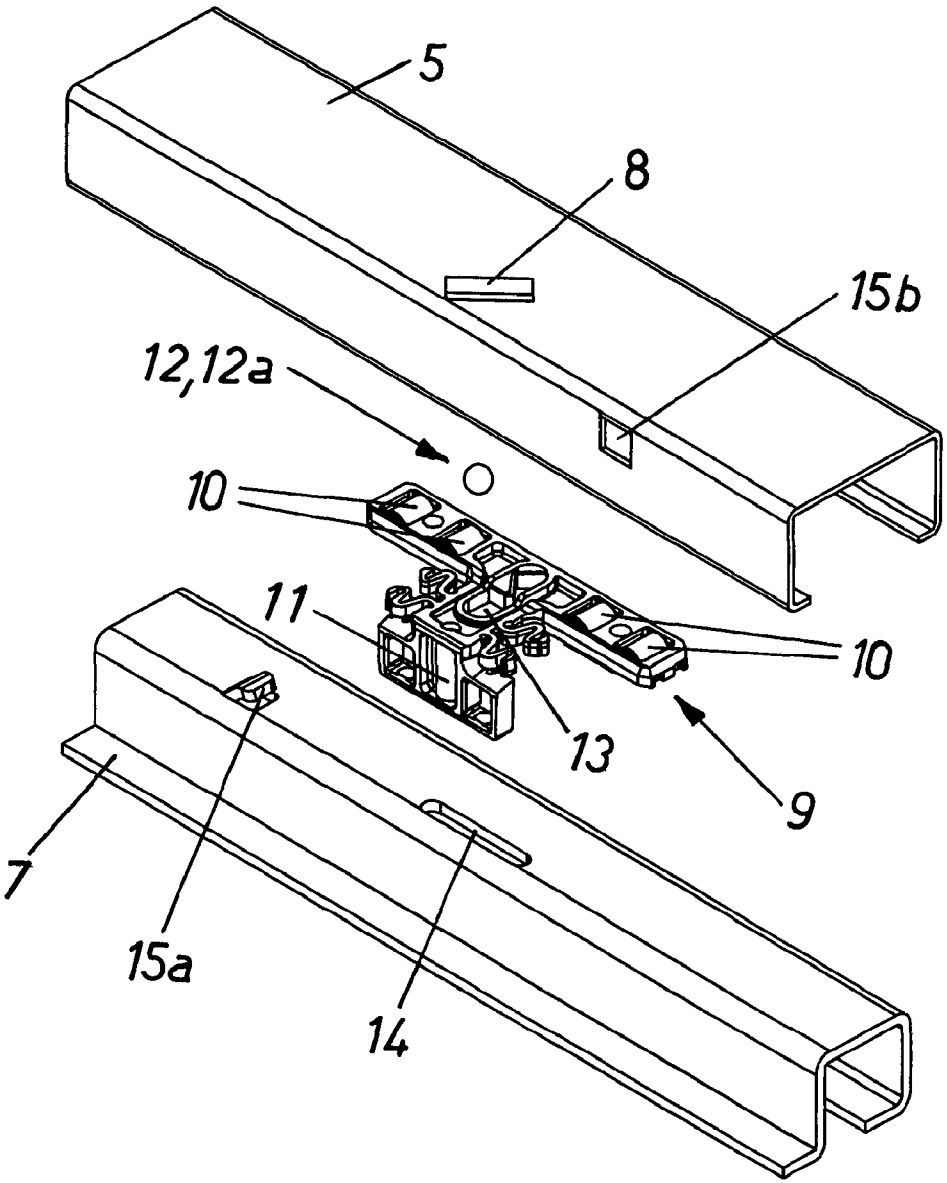
FIG. 3 shows an exploded view of a portion of the pull-out guide assembly with the relevant components of the operating sequence control system in order for a carriage running error to be compensated.

FIG. 3 shows a portion of the pull-out guide assembly 3 in an exploded view with the first rail 7 (middle rail) and the second rail 5 (drawer rail) and with a running carriage 9 displaceable between those two rails 5, 7. The running carriage 9 comprises in known fashion load-transmitting rolling bodies 10 with horizontal axes of rotation and at least one lateral rolling body 11 having a vertical axis of rotation. In addition, the running carriage 9 comprises a rolling or sliding body (collectively referred to as "sliding body") 12 which is in the form of a ball and which is denoted hereinafter by reference 12*a*. The ball 12*a* is loosely relocatably guided within a slot-like guide 13. In the assembled condition, the ball 12*a* engages at times with the coupling portion 8 which projects downwardly at the underside of the running limb of the second rail 5. The first rail 7 has an evasion opening 14 in the form of a longitudinal slot arranged axially relative to the extension direction of the drawer 6. The rails 5, 7 have end abutments 15*a*, 15*b*, wherein the running carriage 9 in the closed position of the two rails 5, 7 relative to each other should ideally be disposed in spaced relationship with respect to both end abutments 15*a*, 15*b*.

Figure 4A:
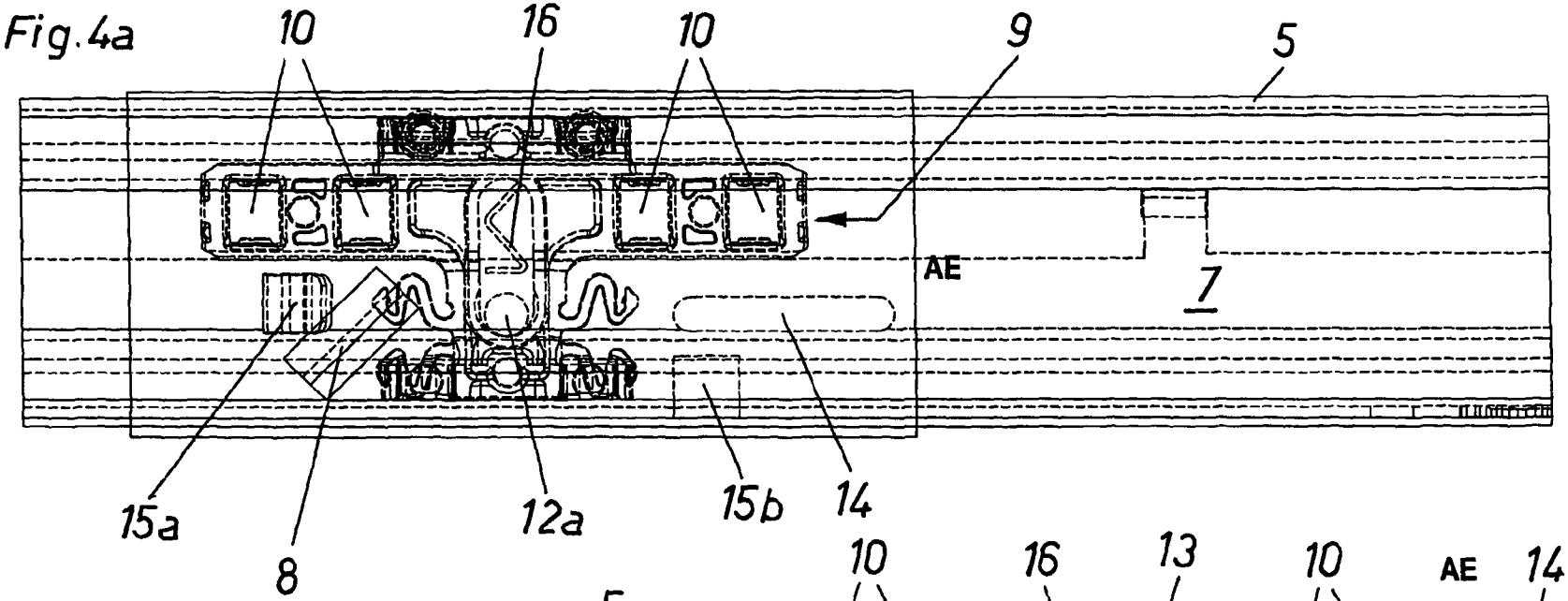
FIGS. 4*a* and 4*b* show a plan view illustrating the running carriage disposed between the rails without having a carriage running error and an enlarged detail view in relation thereto.
Figure 4B:
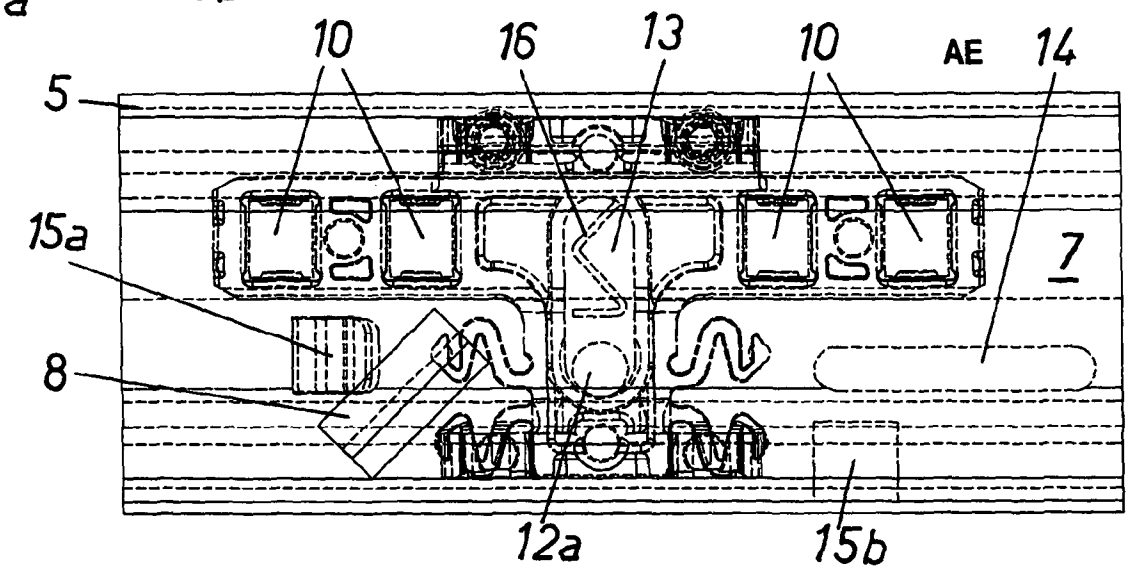

FIGS. 4*a* and 4*b* show the ideal case of the position of the running carriage 9 which is mounted displaceably between the rails 5, 7. FIG. 4*b* shows a plan view of the pull-out guide assembly 3 in the closed position of the rails 5, 7. As in this case, the running carriage 9 would not be visible, the components arranged between the rails 5, 7 are shown in broken lines. FIG. 4*a* now shows the ideal closed position of the running carriage 9. As in the illustrated closed position of the rails 5, 7 the running carriage 9 is disposed in spaced relationship with respect to the end abutments 15*a* and 15*b*. Correction of the running carriage position is therefore not required. FIG. 4*b* shows the detail region of FIG. 4*a* on an enlarged scale. The ball 12*a* which is loosely guided within the guide 13 can be seen here. Visible is a spring device 16 arranged in the guide 13, and the spring device 16 is in the form of a resilient molded plastic portion and by which the ball 12*a*, in the closing movement of the drawer 6, is movable again into the illustrated position in order to provide a ready position for the next extension process. It is also possible to clearly see the coupling portion 8 in the form of an inclined surface at the underside of the extensible second rail 5 and the evasion opening 14 in the form of a slot for the ball 12*a*.

Figure 5A:
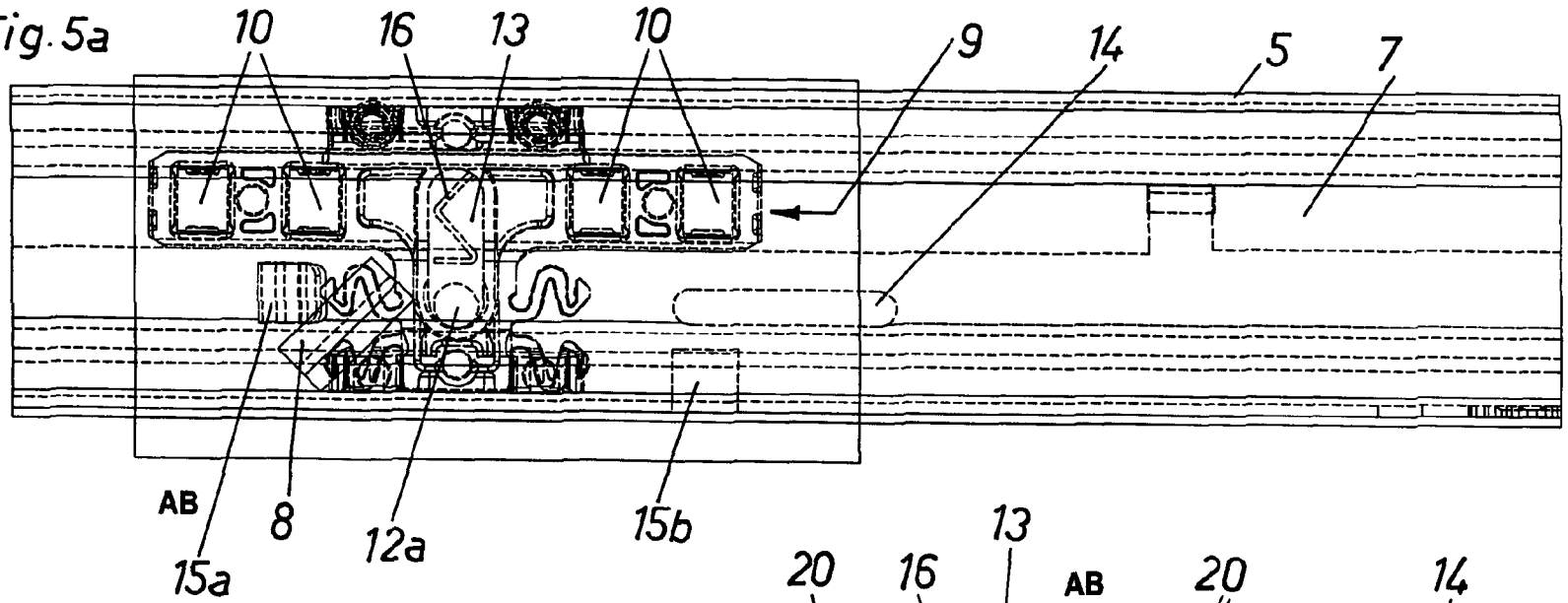
FIGS. 5*a* and 5*b* show a plan view illustrating the running carriage disposed between the rails having a carriage running error and an enlarged detail view in relation thereto.
Figure 5B:
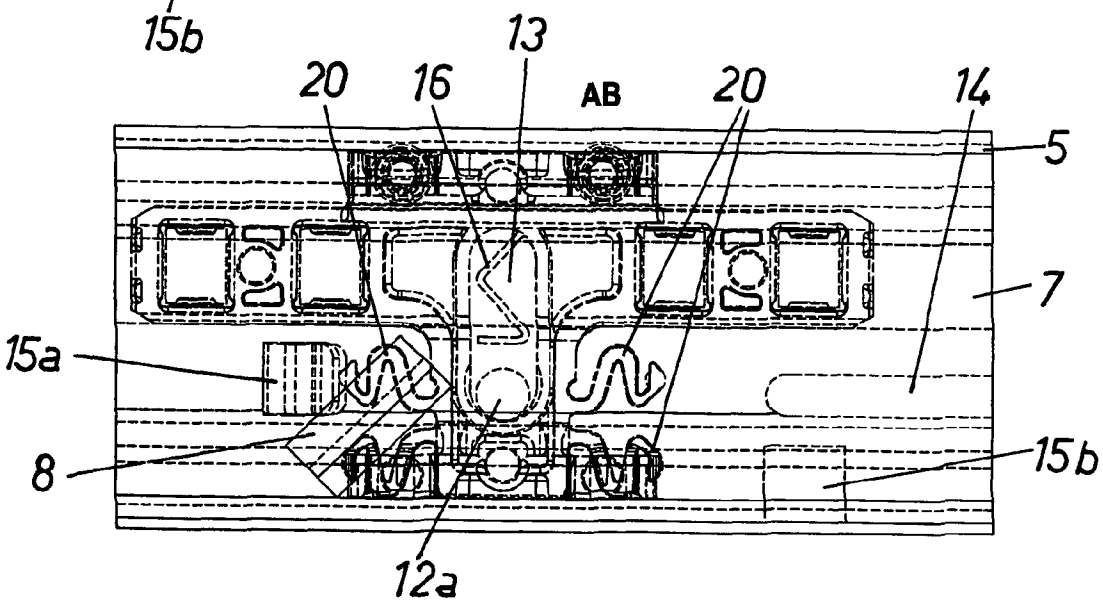

FIGS. 5*a* and 5*b* show a similar view to FIGS. 4*a* and 4*b*, wherein—due to the slip between the rolling bodies 10 and the rails 5, 7—the running carriage 9 is incorrectly positioned. That situation occurs when the running carriage 9 already abuts against the end abutment 15*a* of the first rail 7 before the fully closed position of the rails 5, 7 relative to each other is reached. The consequence of this is that it would be necessary to press against the extensible second rail 5 to attain the complete closed position, by applying a force, in which case the rail 5 is pushed over the rolling bodies 10, which requires higher forces and would entail corresponding wear phenomena for the running carriage 9. In addition, that position of the running carriage 9 would mean that, when a retraction device having a damper is provided, the drawer 6 could no longer be completely pulled into the furniture carcass 2. Now, to overcome that problem, there is the inclined coupling portion 8 which, in the movement for opening the drawer 6, by virtue of the doubled speed thereof relative to the running carriage 9, engages the ball 12*a* so as to couple the running carriage 9 and positively displaces the running carriage 9 for a short time at the doubled speed. When the ball 12*a* reaches the evasion opening 14 in the drawer extension movement, the ball 12*a* can immerse thereinto, whereby the coupling is released and the coupling portion 8 can unimpededly overtake the running carriage 9. The evasion opening 14 is of such a configuration that the ball 12*a* can admittedly engage somewhat therein but cannot drop completely therethrough. It is also possible to see—as is known per se—dampers 20 in the form of meander-shaped spring buffers, wherein the impact of the running carriage 9 in the end positions thereof can be damped by the dampers 20.

Figures 6A, 6B, 7A, 7B:
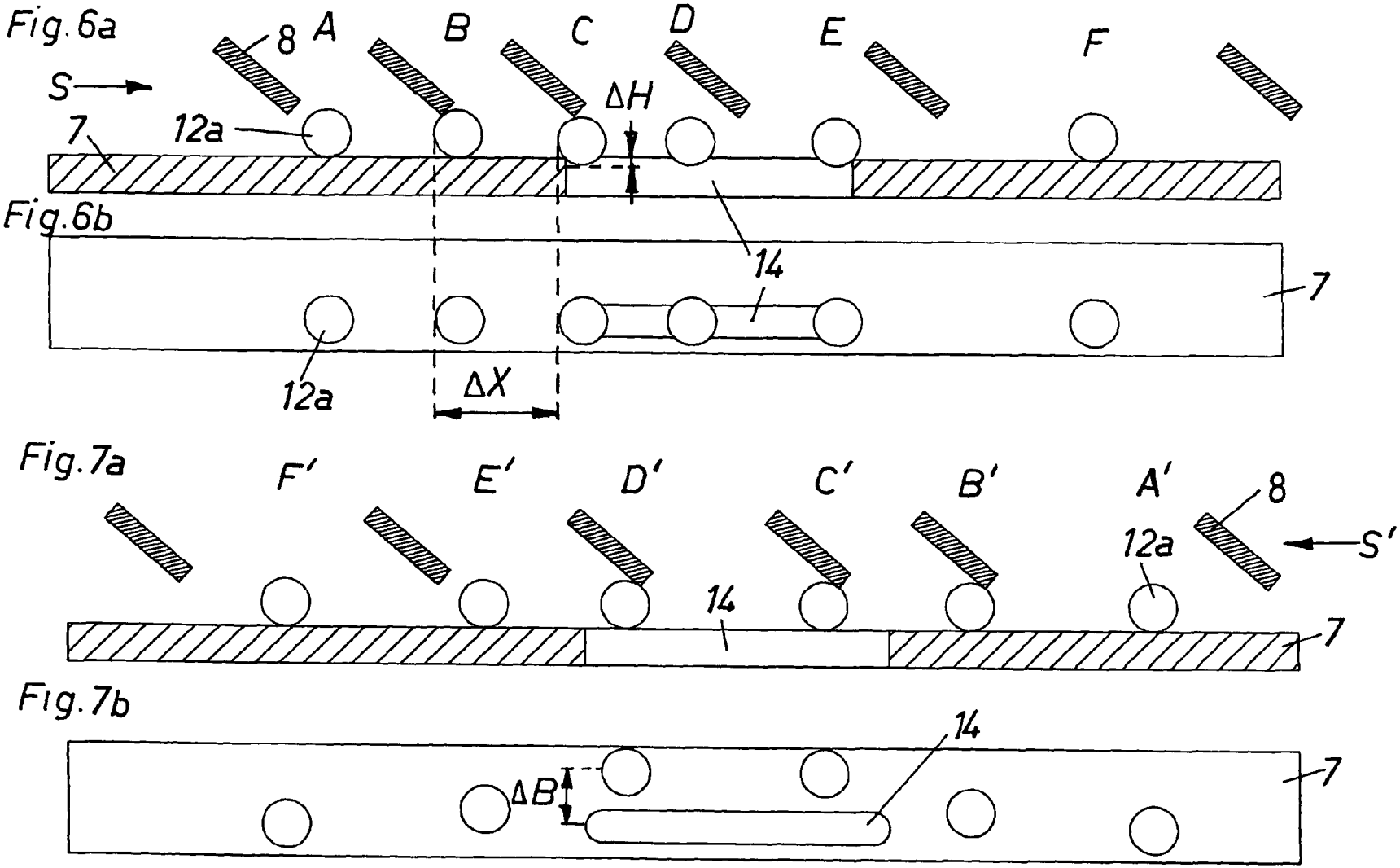
FIGS. 6*a* and 6*b* show a diagrammatic side view of the various ball positions during the opening movement of the drawer and a plan view in relation thereto.
FIGS. 7*a* and 7*b* show a diagrammatic side view of the various ball positions during the closing movement of the drawer and a plan view in relation thereto.

FIG. 6*a* shows a diagrammatic side view of the ball 12*a* associated with the running carriage 9, corresponding to the positions A through F which occur in succession in time during the opening movement in the direction of the arrow S of the drawer 6. Reference numeral 8 denotes the coupling portion 8 associated with the second rail 5 (pull-out rail). FIG. 6*b* shows a plan view of the first rail 7 (central rail) with the respective positions of the ball 12*a*, that respectively correspond to the upper position shown in FIG. 6*a*. FIGS. 6*a* and 6*b* therefore show time relationships of the relative movement of the coupling portion 8 and the ball 12*a* relative to the first rail 7 during the opening movement of the drawer 6, with a carriage running error being corrected.

In the position A, the coupling portion 8 is still behind the ball 12*a*. It is to be noted that—as is usual in the case of differential pull-out guide assembles 3—the pull-out rail 5 moves at approximately double the speed of the running carriage 9 (and therewith the ball 12*a*).

In the position B the coupling portion 8 has already caught up with the ball 12*a*, the ball 12*a* (and therewith the running carriage 9) being coupled to the pull-out rail 5 which is moving faster. The ball 12*a* is therefore clamped between the first (middle) rail 7 and the coupling portion 8 so that accordingly the running carriage 9 is entrained with the pull-out rail 5, namely at double the speed.

It will be seen in position C that the ball 12*a* can engage into the evasion opening 14 with height difference ΔH, so that the ball 12*a* can be brought out of engagement with the coupling portion 8 due to the differential height ΔH. It is also possible to see the distance ΔX which corresponds to the travel distance to be corrected in respect of the carriage running error. The distance ΔX can be somewhat greater than the greatest carriage running error which occurs. Correction of the carriage running error is therefore already concluded at position C.

Position D shows that the coupling portion 8 has already overtaken the vertically displaceable ball 12*a* and thus continues to move at double speed relative to the ball 12*a* of the running carriage 9.

At position E, the ball 12*a*, as part of the moving running carriage 9, can come out of the evasion opening 14 again. Position F shows the ball 12*a* of the running carriage 9 on the way in the direction of the end position of the running carriage 9, and the pull-out rail 5 with the coupling portion 8 arranged thereon can be moved into the completely open position.

FIGS. 7*a* and 7*b* show a view corresponding to FIGS. 6*a* and 6*b*, by reference to which the mode of operation involved in the drawer closing process is to be described. In this case, the sequence of the movements is from right to left, that is to say starting from position A' (an open position of the drawer 6) to the position F' (a position of the drawer 6, which is immediately before the fully closed position). The drawer 6 therefore moves in the direction of the arrow S' in the closing operation.

In position A' the coupling portion 8 of the pull-out rail 5, coming from the right, moves quickly towards the ball 12*a*. In position B' the coupling portion 8 has caught up with the ball 12*a* of the running carriage 9 and in that case can be brought to bear against the latter. It is to be noted that, in the entire closing movement—in contrast to the opening movement—no force-locking connection is made between the coupling portion 8 and the ball 12*a*. The coupling portion 8 can only be caused to bear against the ball 12*a*, more specifically to the effect that the ball 12*a* is pressed to the side by the coupling portion 8 in order to be moved around the evasion opening 14, but otherwise the coupling portion 8 can unimpededly pass the ball 12*a*. The ball 12*a* can thus be displaced with width difference ΔB by the inclined surface of the coupling portion 8, as is illustrated at position D'. After the coupling portion 8 has moved past, the ball 12*a* is urged by the spring device 16 shown in FIG. 4*b* again into an initial position intended for the next extension movement of the drawer 6, as is shown in position F'. Starting from that position F' the pull-out rail 5 can be moved with the coupling portion 8 in the direction of the completely closed position.

Figure 8A:
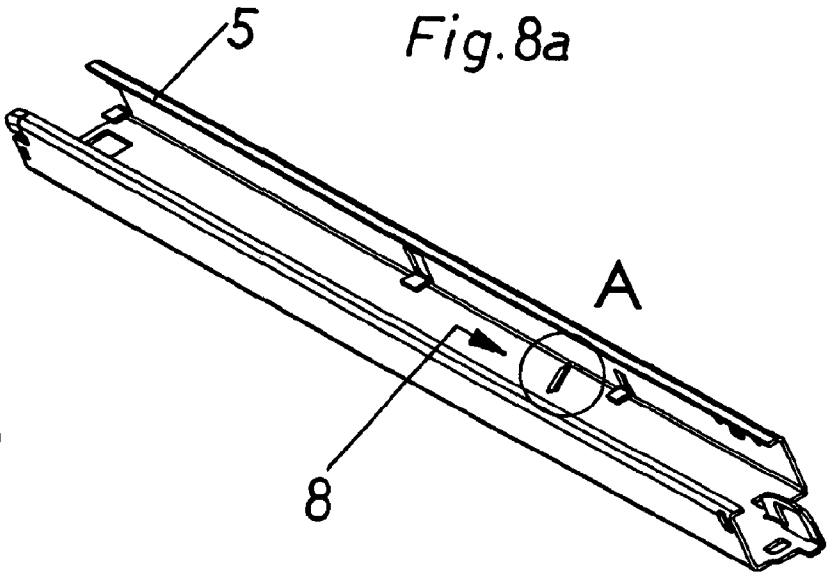
FIGS. 8*a* and 8*b* show a perspective view from below of the pull-out rail with the coupling portion arranged thereon and an enlarged detail view in relation thereto.
Figure 8B:
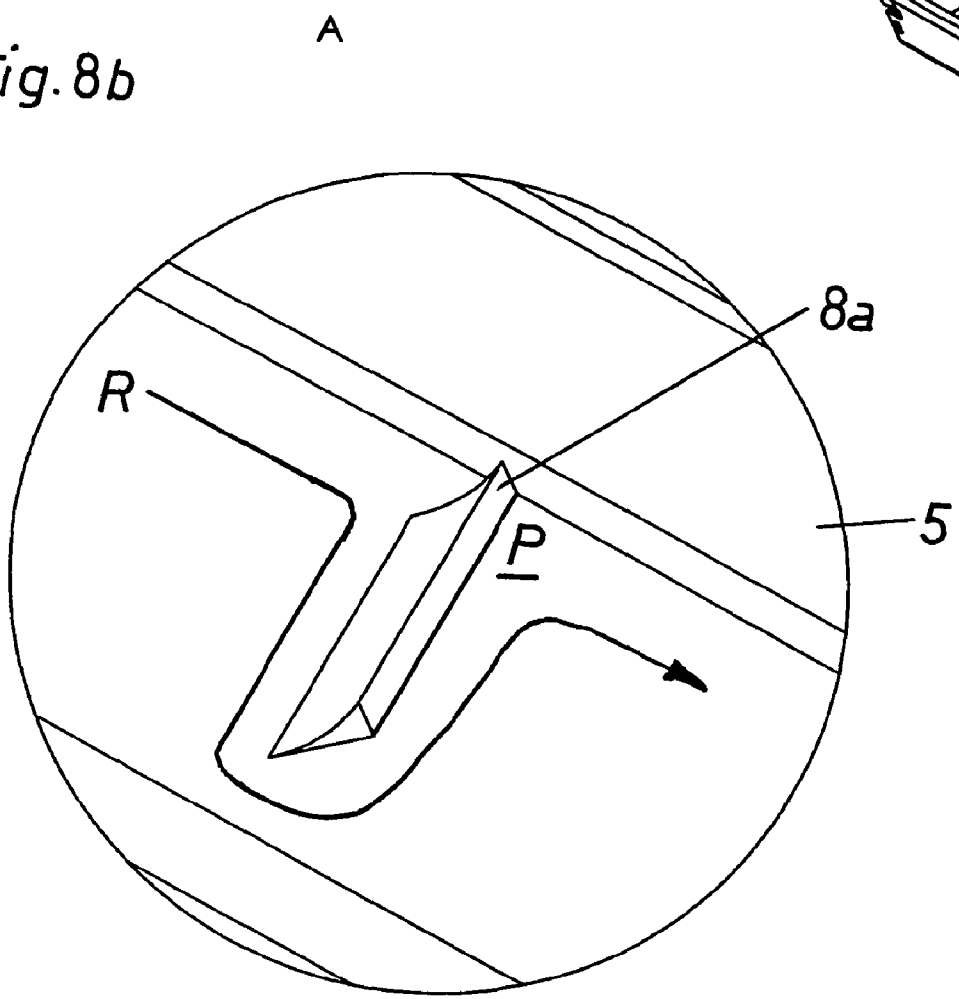

FIG. 8*a* shows a perspective view of the underside of the pull-out rail 5, showing the coupling portion 8 arranged thereon. FIG. 8*b* shows a view on an enlarged scale of the circled region in FIG. 8*a*. The coupling portion 8 is arranged on a running limb of the pull-out rail 5 transversely relative to the extension direction (for example within an angle of between 10° and 90°, preferably between 30° and 60°). It is possible to see from the enlarged detail A the coupling portion 8 having a control edge 8*a* in the form of an inclined surface. When a carriage running error which occurs is corrected in the drawer opening process, the ball 12*a* is disposed during the correction procedure in the parking position P (sec position B, C in FIG. 6*a*) until the ball 12*a* passes into the evasion opening 14 and is thus liberated from the control edge 8*a*. In the contrasting drawer closing operation, the ball 12*a*, coming from the opposite direction, follows the illustrated path of movement R, in which lateral displaceability of width difference AB (see position D' in FIG. 7*b*) is made possible, with the ball 12*a* being guided around the evasion opening 14. In this case the control edge 8*a* is arranged on the running limb of the rail 5 so that the ball 12*a* can be moved laterally therepast. After that passing movement the ball 12*a* is urged into its original path of movement again by the spring device 16.

Figure 9:
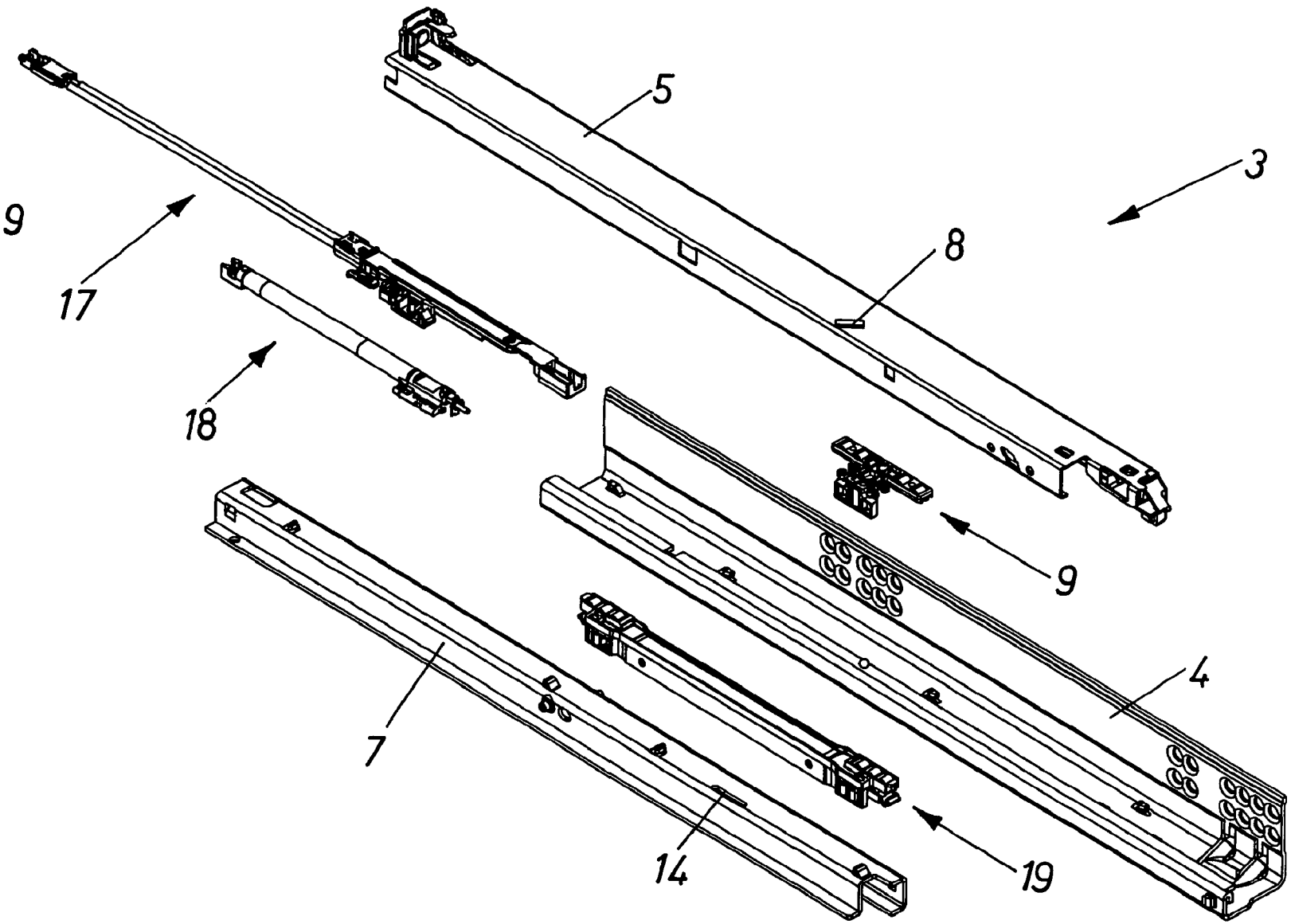
FIG. 9 shows an exploded view of the pull-out guide assembly according to the invention.

FIG. 9 shows an exploded view of the pull-out guide assembly 3 according to the invention. In this case, a first rail 7 (middle rail), a second rail 5 (drawer rail) mounted thereon and a third rail 4 (carcass rail) are provided, which are adapted to be displaceable relative to each other. At least one running carriage 9 is arranged in accordance with the aspect of the present invention between at least two of the aforementioned rails 4, 5, 7. In addition, it is also possible to arrange at least one running carriage 19 in accordance with the state of the art. Furthermore the pull-out guide assembly comprises a spring-loaded retraction device 17 with which the extensible rails 5, 7 can be transported into their completely closed position. A damping device 18, preferably a piston-cylinder unit which can be filled with a fluid, is provided to damp the closing movement.

The present invention is not limited to the illustrated embodiment but embraces or extends to all variants and technical equivalents which can fall within the scope of the following claims. The positional references adopted in the description such as for example up, down, lateral, and so forth are related to the directly described and illustrated Figure and upon a change in position are to be appropriately converted to the fresh position. As the running carriage 9 usually rather tends to assume a trailing position between the rails 5, 7, correction was provided in accordance with the description during the opening movement of the drawer 6. It will be appreciated that with suitable means it is also possible to implement a correction during the closing movement of the drawer 6.

The invention claimed is:

1. A pull-out guide assembly for a drawer, comprising:

a first rail having an evasion opening;

a second rail including a coupling portion;

a running carriage arranged between said first rail and said second rail, said running carriage including load-transmitting rolling bodies, said running carriage being configured to be coupled to said second rail; and a sliding body loosely displaceably mounted to said running carriage for coupling said running carriage to said coupling portion of said second rail, said sliding body being configured to move into said evasion opening of said first rail during opening movement of the drawer so as to become uncoupled from said coupling portion and to thereby allow said coupling portion to uncouple from said running carriage and pass said running carriage.

2. The pull-out guide assembly according to claim 1, wherein said sliding body is mounted so as to be vertically movable over a height difference along a direction substantially perpendicularly to an extension direction of said first rail and said second rail.

3. The pull-out guide assembly according to claim 1, wherein said evasion opening comprises a recess in said first rail into which said sliding body is engageable so as to release the coupling between said running carriage and said second rail.

4. The pull-out guide assembly according to claim 1, wherein said coupling portion is configured to be brought into contact with said sliding body during closing movement of the drawer so as to guide said sliding body laterally past said evasion opening.

5. The pull-out guide assembly according to claim 1, wherein said sliding body is mounted to said running carriage so as to be movable in a plane of said second rail with a width difference transverse to an extension direction of the drawer.

6. The pull-out guide assembly according to claim 1, wherein said running carriage comprises a guide, said sliding body being mounted movably in said guide within predetermined limits.

7. The pull-out guide assembly according to claim 6, further comprising a spring device for acting upon said sliding body within said guide, said spring device being configured to, during closing movement of the drawer, move said sliding body into an initial position for the opening movement of the drawer.

8. The pull-out guide assembly according to claim 1, wherein said coupling portion is configured to contact said sliding body such that a movement path of said sliding body during the opening movement of the drawer deviates from a movement path of said sliding body during a closing movement of the drawer.

9. The pull-out guide assembly according to claim 1, wherein said coupling portion comprises a control edge having an inclined surface for contacting said sliding body so as to couple said running carriage to said second rail.

10. The pull-out guide assembly according to claim 9, wherein said control edge is arranged transversely with respect to a longitudinal direction of said second rail, within an angle of between 10° and 90°.

11. The pull-out guide assembly according to claim 9, wherein said control edge is arranged on a running limb of said second rail, and said sliding body and said coupling portion are configured to move said sliding body laterally past said control edge during closing movement of the drawer.

12. The pull-out guide assembly according to claim 1, wherein said running carriage is arranged between two end abutments, and wherein said sliding body, said evasion opening, and said coupling portion are configured such that said running carriage is coupled to said second rail and uncoupled from said second rail at predetermined positions between said two end abutments by displacement of said first rail and said second rail relative to each other.

13. The pull-out guide assembly according to claim 12, wherein said running carriage is configured to be movable beyond the predetermined locations in a direction of said end abutments after being uncoupled.

14. The pull-out guide assembly according to claim 1, wherein said running carriage has at least one damper for dampening an impact of said running carriage at an end position.

15. The pull-out guide assembly according to claim 1, wherein said sliding body is formed as a ball.

16. The pull-out guide assembly according to claim 1, further comprising a third rail.

17. The pull-out guide assembly according to claim 16, wherein said running carriage is arranged between said first rail and said second rail, or between said first rail and said third rail.

18. The pull-out guide assembly according to claim 16, wherein said third rail is a carcass rail to be fastened to a furniture body, said second rail is a drawer rail to be fastened to the drawer, and said first rail is a middle rail arranged displaceably between said carcass rail and said drawer rail.

19. A drawer comprising a pull-out guide assembly according to claim 1.

20. An item of furniture comprising a drawer according to claim 19.

* * * * *